US010415800B2

(12) United States Patent
Yifan et al.

(10) Patent No.: US 10,415,800 B2
(45) Date of Patent: Sep. 17, 2019

(54) LIGHT FIXTURES WITH INTEGRATED FEATURES

(71) Applicant: ABL IP Holding LLC, Atlant, GA (US)

(72) Inventors: Zhou Yifan, Shanghai (CN); Philip Sieczkowski, Lawrenceville, GA (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

(21) Appl. No.: 15/919,486

(22) Filed: Mar. 13, 2018

(65) Prior Publication Data

US 2018/0266662 A1 Sep. 20, 2018

Related U.S. Application Data

(60) Provisional application No. 62/471,649, filed on Mar. 15, 2017.

(51) Int. Cl.

| | |
|---|---|
| ***F21V 15/01*** | (2006.01) |
| ***F21V 17/06*** | (2006.01) |
| ***F21V 29/70*** | (2015.01) |
| ***F21V 29/87*** | (2015.01) |
| ***F21V 15/015*** | (2006.01) |
| *F21Y 103/10* | (2016.01) |
| *F21Y 115/10* | (2016.01) |
| *F21V 7/28* | (2018.01) |
| *F21V 7/24* | (2018.01) |
| *F21W 131/402* | (2006.01) |

(52) U.S. Cl.

CPC ..... *F21V 17/06* (2013.01); *F21V 15/013* (2013.01); *F21V 15/015* (2013.01); *F21V 29/70* (2015.01); *F21V 29/87* (2015.01); *F21V 7/24* (2018.02); *F21V 7/28* (2018.02); *F21W 2131/402* (2013.01); *F21Y 2103/10* (2016.08); *F21Y 2115/10* (2016.08)

(58) Field of Classification Search

CPC ..... F21V 17/06; F21V 29/87; F21V 29/70; F21V 15/013; F21V 15/015; F21V 7/24; F21V 7/28; F21Y 2103/10; F21Y 2115/10; F21W 2131/402

See application file for complete search history.

(56) References Cited

U.S. PATENT DOCUMENTS

| | | | | |
|---|---|---|---|---|
| 3,072,783 | A * | 1/1963 | Harling | F21S 8/086 362/308 |
| 4,234,912 | A * | 11/1980 | Barnes | F21S 8/086 362/145 |
| 6,382,817 | B1 | 5/2002 | Chelf | |
| 9,206,970 | B2 | 12/2015 | Halliwell et al. | |

(Continued)

OTHER PUBLICATIONS

CA 2,998,133, "Office Action," dated Apr. 30, 2019, 3 pages.

*Primary Examiner* — Donald L Raleigh

(74) *Attorney, Agent, or Firm* — Kilpatrick Townsend & Stockton LLP

(57) ABSTRACT

A light fixture includes a housing, an optic, and a wing. The housing is configured to house at least one light source of the light fixture. The wing extends from the side of the housing. In some embodiments, the housing and wing are monolithically formed as an integral unit. In other embodiments, the optic and wing are monolithically formed as an integral unit. According to further embodiments, the housing, optic, and wing are monolithically formed as an integral unit.

20 Claims, 20 Drawing Sheets

(56) References Cited

U.S. PATENT DOCUMENTS

| | | | | |
|---|---|---|---|---|
| 9,335,009 | B2 | 5/2016 | Halliwell | |
| 9,989,228 | B2 * | 6/2018 | Tuchler | F21S 8/026 |
| 2005/0041417 | A1 | 2/2005 | Mackin | |
| 2008/0137205 | A1 * | 6/2008 | Spencer | F24J 2/18 359/601 |
| 2012/0087118 | A1 * | 4/2012 | Bailey | F21V 31/005 362/235 |
| 2012/0201032 | A1 * | 8/2012 | Holten | F21S 8/00 362/296.01 |
| 2016/0195256 | A1 * | 7/2016 | Schwarz | F21V 31/00 362/294 |
| 2018/0284339 | A1 * | 10/2018 | Isbrucker | F21V 7/0016 |

* cited by examiner

LIGHT FIXTURES WITH INTEGRATED FEATURES

REFERENCE TO RELATED APPLICATIONS

This application claims the benefit of U.S. Provisional Application No. 62/471,649, filed on Mar. 15, 2017 and entitled LIGHT FIXTURES WITH INTEGRATED FEATURES, the content of which is hereby incorporated by reference in its entirety.

FIELD OF THE INVENTION

Embodiments of the present invention relate to light fixtures formed with integrated features and that are suitable for task lighting and other applications.

BACKGROUND

Light fixtures that are relatively inexpensive and easy-to-install are desired by homeowners for installation in basement and/or garage workshops. Such fixtures are often referred to as "shoplights" given their intended installation location (in workshops) and, in use, provide task lighting in such environments, such as over a workbench or other work surface. Often the light fixtures are linear in nature so as to extend over the desired area.

The light fixtures are typically portable and easily installed by a non-electrician. Most such fixtures are equipped with a cord and plug-in connector that plugs into a standard electrical outlet. The fixtures are typically ceiling mounted or suspended using chains or cables and "s" hooks over work surfaces to provide task lighting to such surfaces. The market for these fixtures is extremely competitive and the margins low. Thus, the ability to manufacture and assemble these fixtures less expensively is of paramount importance.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

According to some embodiments, a light fixture includes a housing that is configured to house at least one light source of the light fixture, an optic, and a wing extending from a side of the housing. In some embodiments, the housing, optic, and wing are monolithically formed as an integral unit.

In certain cases, the housing includes a thermally conductive plastic and wherein the optic includes a translucent plastic. In various aspects, the wing is constructed from the thermally conductive plastic or the translucent plastic. According to certain embodiments, the wing is a first wing, and the light fixture further includes a second wing extending from a side of the housing opposite from the first wing.

In some embodiments, the light fixture further includes end caps positioned on opposing ends of the light fixture. In various aspects, the light fixture includes the at least one light source, and the at least one light source includes a plurality of light emitting diodes (LEDs). In certain cases, the optic extends below the plurality of LEDs.

According to various embodiments, a light fixture includes a housing that is configured to house at least one light source of the light fixture, an optic, and a wing extending from a side of the housing. In certain examples, the housing and wing are monolithically formed as an integral unit.

In various aspects, the housing and wing include a metal or a thermally conductive plastic. In some cases, the wing is a first wing, and the light fixture further includes a second wing extending from a side of the housing opposite from the first wing. In certain examples, the housing includes optic mounting slots extending along a length of the housing, and the optic includes mounting arms that are configured to engage the optic mounting slots such that the optic is slidably mounted on the housing. In some embodiments, the light fixture further includes end caps positioned on opposing ends of the light fixture. In various examples, the light fixture further includes the at least one light source, and the at least one light source includes a plurality of light emitting diodes.

According to certain embodiments, a light fixture includes a housing that is configured to house at least one light source of the light fixture, an optic, and a wing extending from a side of the housing. In some embodiments, the optic and wing are monolithically formed as an integral unit.

In some examples, the optic and wing include a translucent plastic. In various cases, the housing includes optic mounting slots extending along a length of the housing, and the optic includes mounting arms configured to engage the optic mounting slots such that the optic and wing are slidably mounted on the housing. In certain examples, the wing is a first wing, and the light fixture further includes a second wing extending from a side of the housing opposite from the first wing. In some aspects, a cross-sectional geometry of the wing is arcuate shaped. In various embodiments, the light fixture further includes end caps positioned on opposing ends of the light fixture. In certain aspects, the light fixture further includes the at least one light source, and the at least one light source includes a plurality of light emitting diodes.

Various implementations described in the present disclosure can include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures can be designated by matching reference characters for the sake of consistency and clarity.

DETAILED DESCRIPTION

Figure 1:
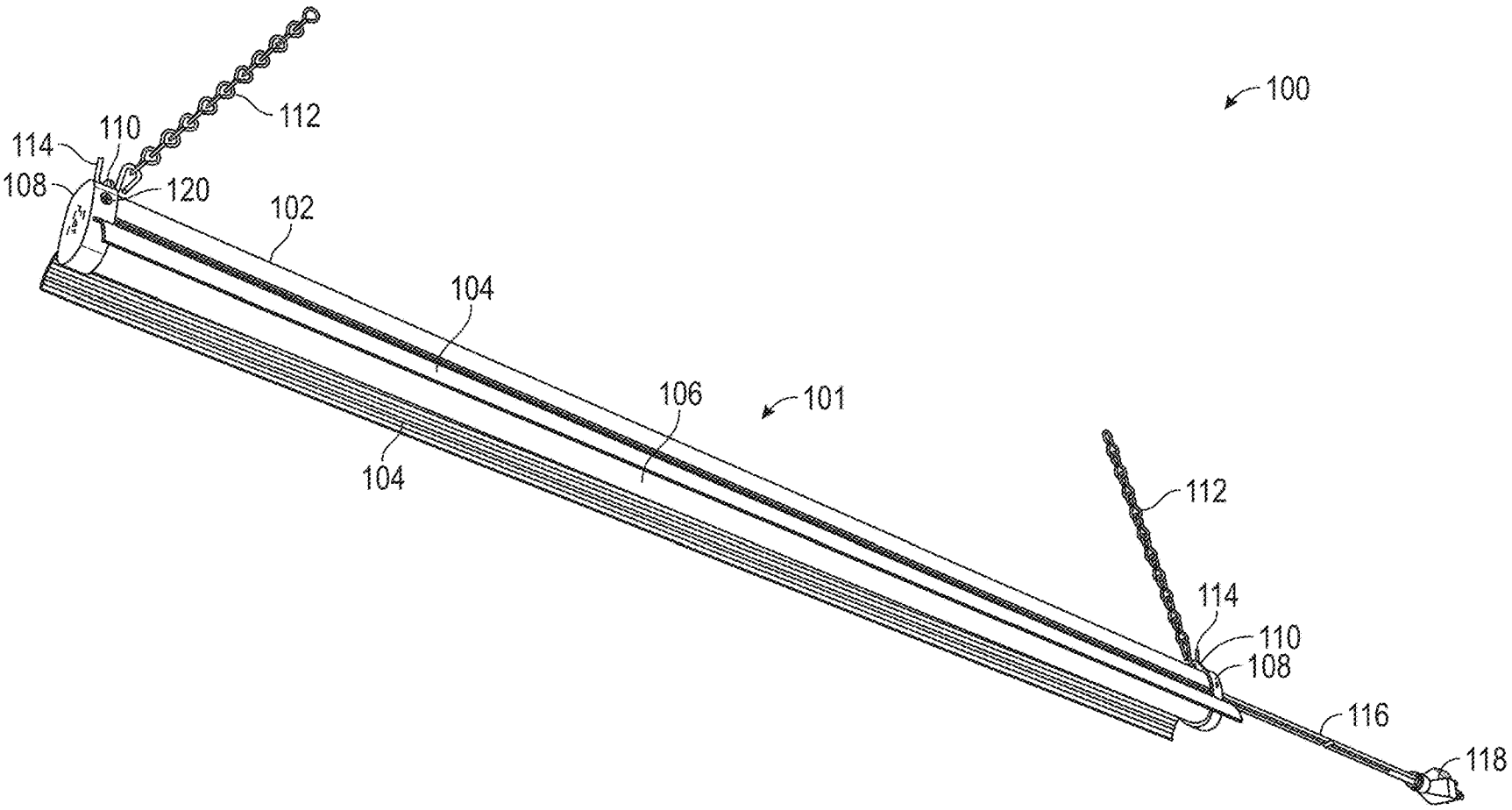
FIG. 1 is a bottom perspective view of an example of a light fixture according to embodiments of the present disclosure.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments of the present invention relate to light fixtures having integrated features that expedite the manufacturing process and thus reduce the manufacturing cost associated with such fixtures.

In certain embodiments, the light fixture includes a housing that supports and houses in it at least one light source with associated electronics. At least one wing extends from the housing to direct the light emitted from the at least one light source as desired. In some examples, wings extend from opposing sides of the housing, although they need not in other embodiments. An optic or lens is positioned under the at least one light source also to control the light distribution from the light fixture. An end cap may be optionally positioned on each end of the light fixture. In various aspects, the end caps assembled on the light fixture enclose the light fixture and impart a polished appearance to the light fixture.

The housing can be of any shape and dimension. In some embodiments, the housing is linear; however, in other embodiments, the housing may be square, circular, hexagonal, elliptical, or have various other shapes and/or dimensions as desired. In some embodiments, the housing is formed from a material having suitable thermal management capabilities so as to conduct heat generated by the light fixture during use. Various materials having suitable thermal management capabilities for the housing include, but are not limited to, various metallic materials (e.g., aluminum or other suitable metallic materials), thermally conductive plastics (e.g., CoolPoly® from Celanese or other suitable plastics), or various other suitable materials. Optionally, fins or other heat dissipating structures may be provided on the housing to further enhance heat transfer from the fixture. The housing may be formed using a variety of different technologies or processes, including, but not limited to, extrusion, roll-forming, die-forming, stamping, casting, etc.

In certain examples, the housing defines a cavity to accommodate the electrical components of the fixture, including, but not limited to one or more drivers. The cavity may be of any shape or size, depending on the dimensions of the components it is intended to house. In some embodiments, the housing may include a mounting plate. The electrical components may be positioned within the cavity and optionally supported by the top surface of the mounting plate.

Optionally, in some embodiments, mounting slots may be formed on and along the lower surface of the mounting plate for attachment of other fixture components to the housing. As one non-limiting example, a light source mounting slot may be provided for retaining the at least one light source. In other examples, an optic mounting slot may be provided for retaining the optic on the housing.

In some embodiments, the at least one light source is a plurality of light emitted diodes ("LEDs") arranged in any number and/or pattern on a printed circuit board ("PCB"). In other examples, light sources other than LEDs may be utilized. The LEDs may be single-die or multi-die LEDs, DC or AC, can be organic light emitting diodes, or can be any combination thereof. White, color, or multicolor LEDs, or can be any combination thereof, may be used. Moreover, the LEDs need not all be the same color; rather, mixtures of LEDs may be used. In some embodiments, the PCB with associated LEDs may be slid into the light source mounting slot of the housing. In various embodiments, the light source mounting slot is oriented such that the LEDs emit light directly downwardly from the light fixture. In other embodiments, the light source mounting slot may be positioned such that the LEDs are oriented at an angle within the housing so as to emit light at an angle from nadir.

In certain embodiments, the optic is mounted on or positioned relative to the housing so as to extend below the LEDs or other light source. In various examples, the optic may be formed from any suitable translucent material that permits the passage of light including, but not limited to acrylic, polycarbonate, silicone, or various other suitable materials. Optionally, the optic is imparted with optical enhancements including, but not limited to, ribbing, prisms, frosted appearance, or various other suitable enhancements to achieve the desired light distribution and effect from the light fixture. In some non-limiting embodiments, the optic is formed from a polymeric material (e.g., polycarbonate) and via extrusion.

In some embodiments, mounting arms are provided on the optic and are configured to engage the optic mounting slots extending along the housing so as to retain the optic on the housing. In this way, the optic may be slid into the housing. While mounting slots are provided in some embodiments, the light sources and/or optic may be retained on the housing using other attachment methods, including, but not limited to, mechanical fastening devices, chemical methods (e.g., adhesives, etc.), or various other suitable attachment mechanisms.

The wing may extend from one or both sides of the housing. The wings may have any cross-sectional geometry including, but not limited to flat, concavely curved, convexly curved, parabolic, stepped, or various other suitable shape. In various embodiments, the wings may extend to any depth. In certain embodiments, the wings may have smooth or textured (e.g., baffled) surfaces. The wings may be formed of any suitable material, including, but not limited to, metallic materials, polymeric materials, and other suitable materials. The surface of the wings may be, or may be rendered, reflective so as to have a high surface reflectivity. In some non-limiting examples, the wings have a reflectivity of between 96%-99.5%, inclusive, such as from about 98.5-99%. In one embodiment, the surface of the wings comprises polished metals including, but not limited to, polished aluminum. In other embodiments, reflective coatings, including reflective paints or other reflective compositions, are applied to the wings to attain the desired reflectivity. In still other embodiments, the wings are provided with no additional surface enhancements to alter the optical properties inherent in the material from which the wings are made.

In certain embodiments, the housing and wings are monolithically formed as an integral or unitary component. See, e.g., FIGS. 6-11. In various aspects, the unitary component including the housing and wings is formed from a material having suitable thermal management capabilities so as to conduct heat generated by the fixture during use, such as the suitable metals and thermally conductive plastics described above. In one non-limiting embodiment, the housing and the wings are formed integrally or monolithically from aluminum.

In some other embodiments, the wings and optic are monolithically formed as an integral or unitary component. See, e.g., FIGS. 12-25. In some non-limiting examples, the unitary component including the wings and optic is formed integrally or monolithically from a translucent polymeric material. In one non-limiting embodiment, the wings and optic are extruded together as a unity piece that is retained on the housing (such as via engagement of mounting arms with optic mounting slots on the housing). In such embodiments and upon activation of the light sources, light emitted by the LEDs (or other light source) passes through the optic, after which some of the emitted light impinges on the wings 104. Because of the translucent nature of the wings, some light is able to pass upwardly through the wings, imparting a glowing effect to the wings. Thus, unlike the embodiments where the wings are formed of a non-translucent material (e.g., metal), in this embodiment the light fixture emits light both downwardly and upwardly.

In some aspects, embodiments of the light fixture having translucent wings may have increased lumen output, which makes the light fixture more efficient than a light fixture having non-translucent wings but otherwise identical to the light fixture having translucent wings. In some non-limiting examples, the lumen output is increased up to about 25%, such as from about 12-15% increased lumen output. In one non-limiting example, the light output of an embodiment of the light fixture whereby the wings were formed of a translucent plastic was compared against the light output of an embodiment of the light fixture whereby the wings were formed of aluminum. Both fixtures were four feet long and included a 35 watt light engine. The light fixture with the translucent wings generated 3200 lumens whereas the light engine with non-translucent wings generated only 2800 lumens. Thus, the embodiment with the translucent wings enjoyed a 14% lumen output improvement.

In various other embodiments, the housing, wings, and optic are all monolithically or integrally formed. See, e.g., FIGS. 1-5. In some embodiments, the housing, wings, and optic may be formed via a co-extrusion process or through another suitable process. In some non-limiting examples, the housing may be extruded from a thermally conductive plastic, and the optic may be extruded from a translucent plastic. The wings can be extruded from either the thermally conductive plastic (for improved thermal management) or the translucent plastic (for increased lumen output) or can be formed of a different material.

End caps may be positioned on each end of the light fixture to hold the fixture components in place and impart a polished appearance to the fixture. The end caps may be formed of any material, but in some embodiments are formed of a polymeric material. One or more screws may be used to secure the end caps onto the fixture. Alternatively, the end caps may be snap-fitted onto the fixtures.

One or more eyelets may be integrated (e.g., molded, monolithically formed, or otherwise attached) on each end cap. During installation, chains or other mounting features (e.g., s-hooks) can engage the eyelets to suspend fixture. Multiple eyelets may be positioned on each end cap to permit mounting of the fixture in different angular orientations. In this way, the tilt of the fixture (and thus the directionality of emitted light from the fixture) can be controlled and adjusted. In certain embodiments, one or more eyelets may be provided at any angle off center of the end cap. In some non-limiting examples, the one or more eyelets may be from about 30°-70° off center, such as from about 45°-60° off center of the end cap. In some embodiments, one or more eyelets are provided on the end caps such that the end caps are symmetrical about their center and thus can be used on either end of the fixture.

A cord and plug-in connector may extend from an end of the fixture. In use, the fixture is installed and plugged into an electrical outlet via the plug-in connector. An "on/off" switch may be provided on the fixtures (such as on an end cap or at any other suitable location) to activate the fixture, although such a switch is not required.

Embodiments of the fixtures described here may be of any length. In some non-limiting embodiments, they may be about 3 feet or about 4 feet long. While a linear fixture is illustrated herein, the fixture can be of any shape and dimension. For example, in some embodiments the fixture can be round, square, triangular, or any other geometrical shape. The light fixtures disclosed herein can be equipped with light engines of any wattage. In some non-limiting examples, the light engines are about 10-60 watts. Regardless of the geometry, integral formation of various parts of the fixture simplifies fixture manufacture and assembly, both of which result in reduced labor and manufacturing costs.

FIGS. 1-5 illustrate an example of a light fixture 100 having a housing 102, wings 104, and an optic 106. In this embodiment, the housing 102, wings 104, and optic 106 are monolithically formed as a single, integral unit 101. In some non-limiting examples, the housing 102 includes a thermally conductive material such as thermally conductive plastic, and the optic 106 includes a translucent material such as translucent plastic. The wings 104 may be the thermally conductive material used for the housing 102, the translucent material used for the optic 106, or another material as desired. Although not shown in FIGS. 1-5 (but see FIG. 14), light sources such as LEDs are retained within the fixture 100 above the optic 106 such that the desired light distribution and effect from the light fixture 100 is achieved. In the example illustrated in FIGS. 1-5, the lower surfaces of the wings 104 are optionally textured and the upper surfaces of the wings 104 are optionally smooth, although they need not be. Moreover, heat sink fins 105 or other heat dissipating structure may be, but does not have to be, provided on the housing 102.

Figure 2:
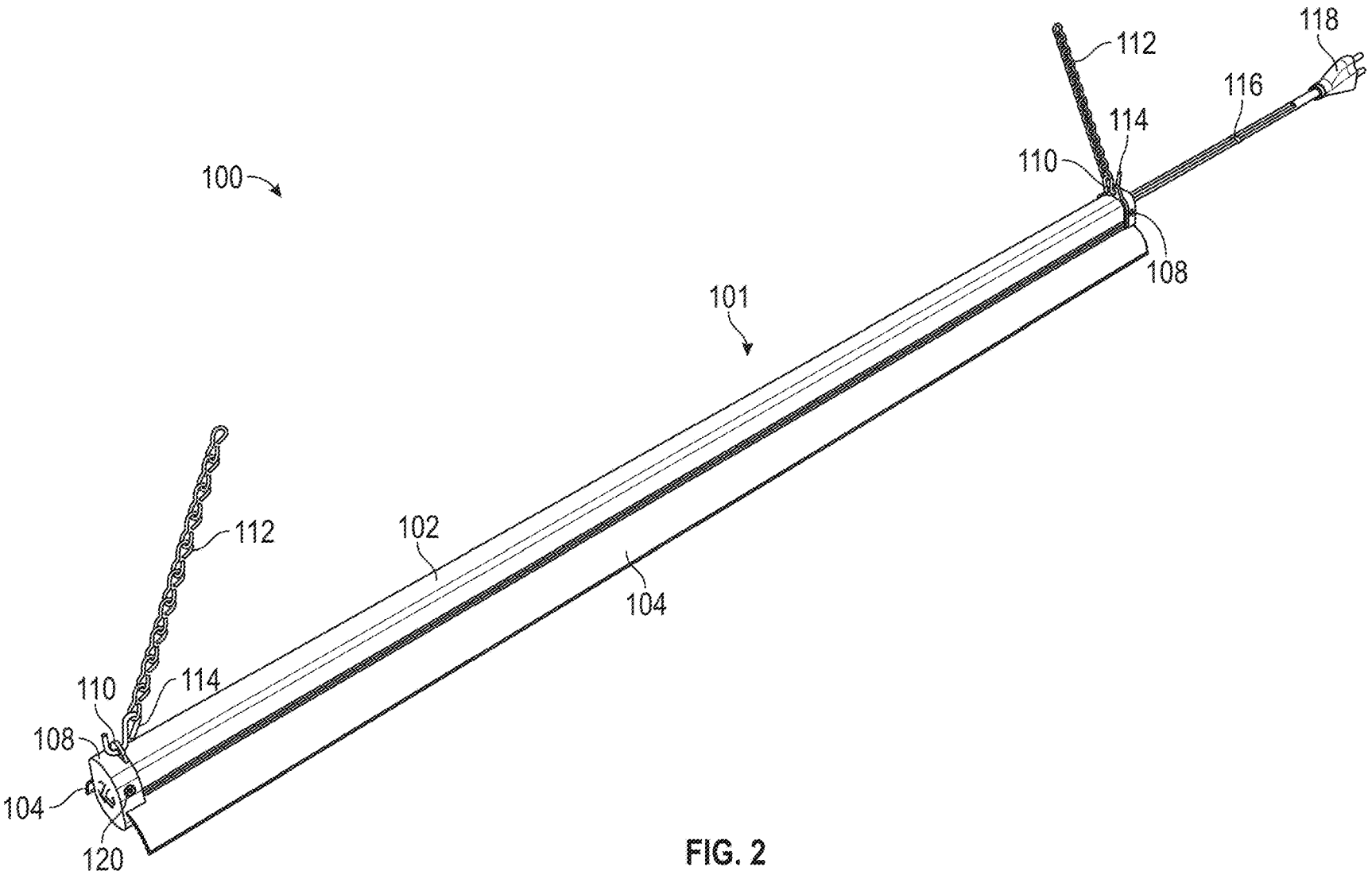
FIG. 2 is a top perspective view of the light fixture of FIG. 1.
Figure 3:
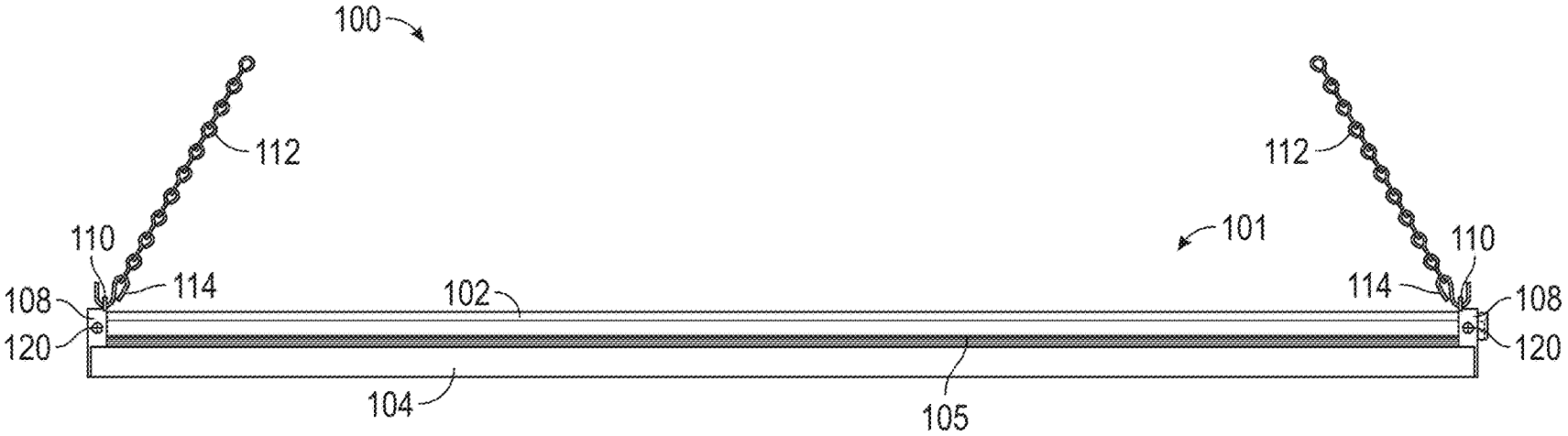
FIG. 3 is a side view of the light fixture of FIG. 1.
Figure 4:
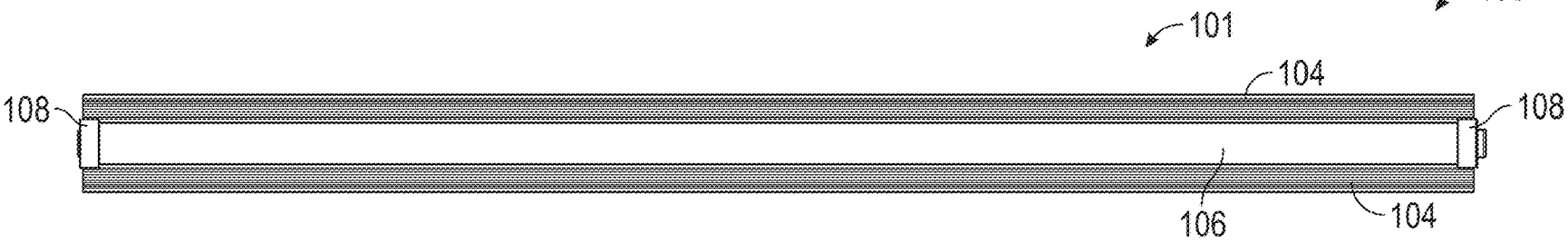
FIG. 4 is a bottom view of the light fixture of FIG. 1.
Figure 5:
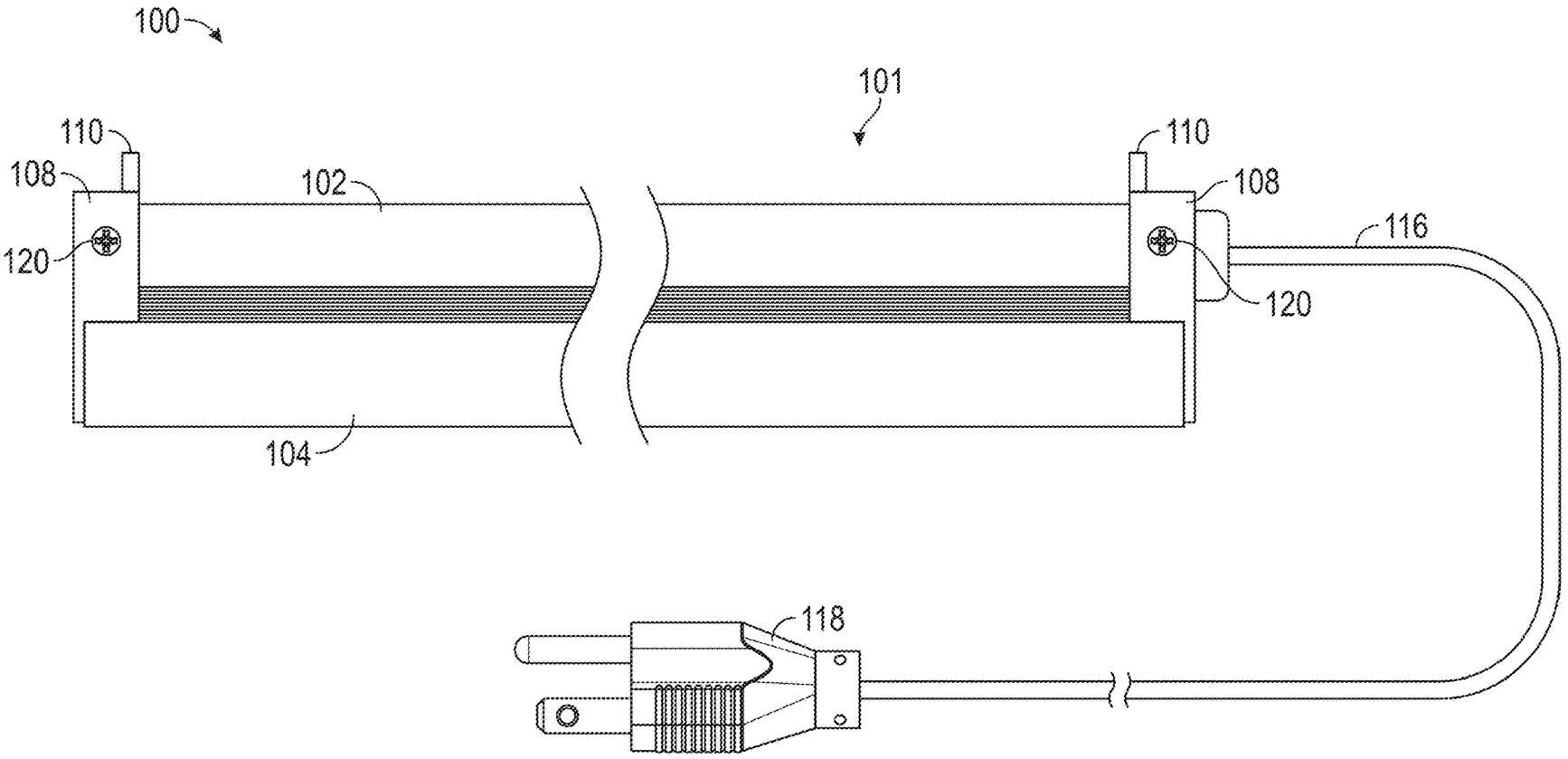
FIG. 5 is another side view of the light fixture of FIG. 1.

As illustrated in FIGS. 1-5, end caps 108 are positioned on opposing ends of the light fixture 100. In this embodiment, the end caps 108 are secured on the fixture 100 through mechanical fasteners 120; however, in other embodiments, other suitable mechanisms may be used to secure the end caps 108 onto the fixture 100. In the embodiment of FIGS. 1-5, the end caps 108 each include one eyelet 110 that is configured to engage hooks 114 of chains 112 (or other suitable mounting features) to suspend the light fixture 100. In this embodiment, the eyelet 110 on each end cap 108 is aligned with a center of the end cap 108. As illustrated in FIGS. 1, 2, and 5, a cord 116 and plug-in connector 118 optionally extend from an end of the light fixture 100.

FIGS. 6-11 illustrate another embodiment of a light fixture 600. The light fixture 600 is substantially similar to the light fixture 100 except that the housing 102 and wings 104 are monolithically formed as a single, integral unit 601 and the optic 106 is removable from the light fixture 100. In some non-limiting examples, the housing 102 and wings 104 both include a thermally conductive material such as thermally conductive metal or plastic.

Figure 6:
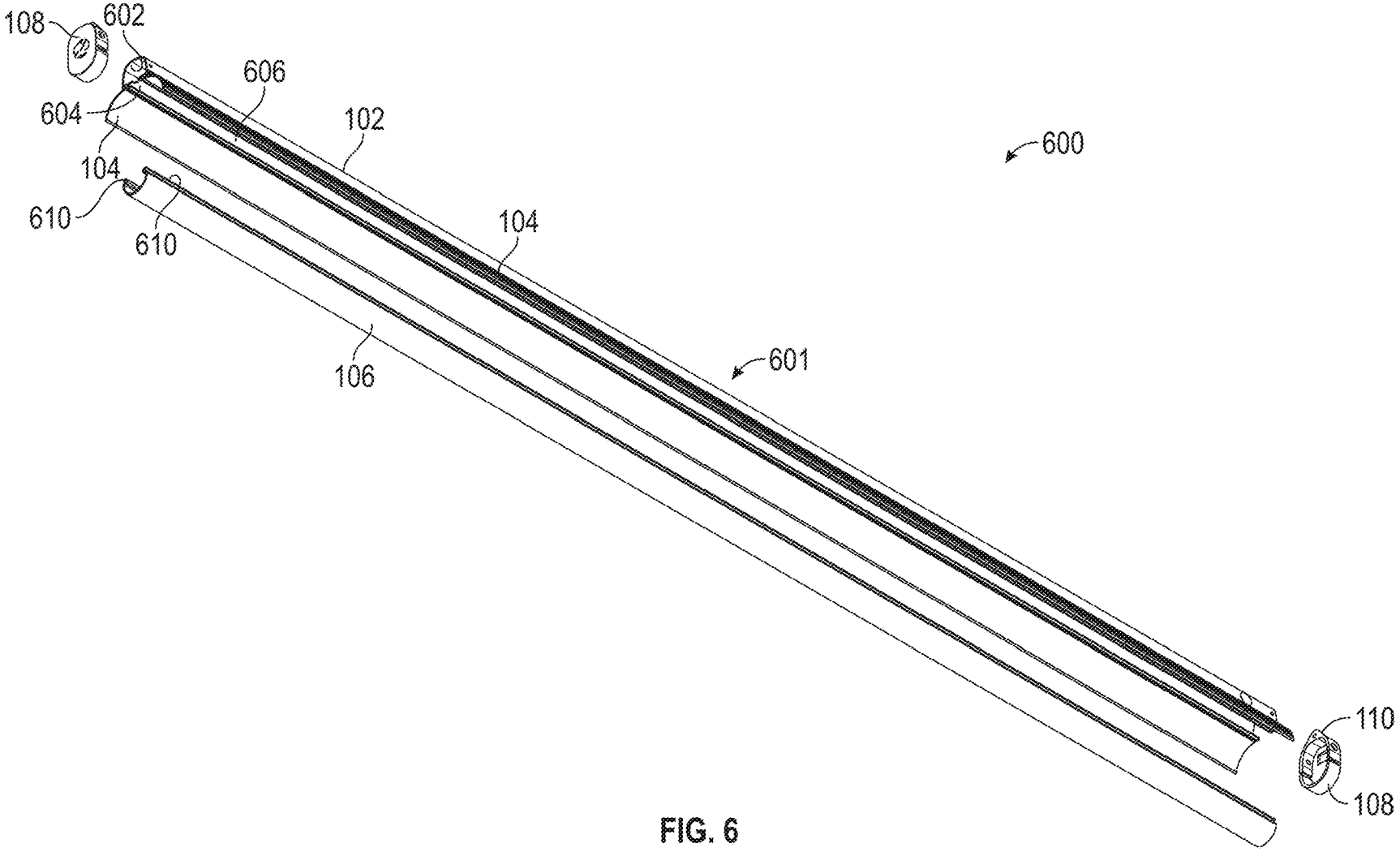
FIG. 6 is an exploded assembly view of an example of a light fixture according to embodiments of the present disclosure.
Figure 7:
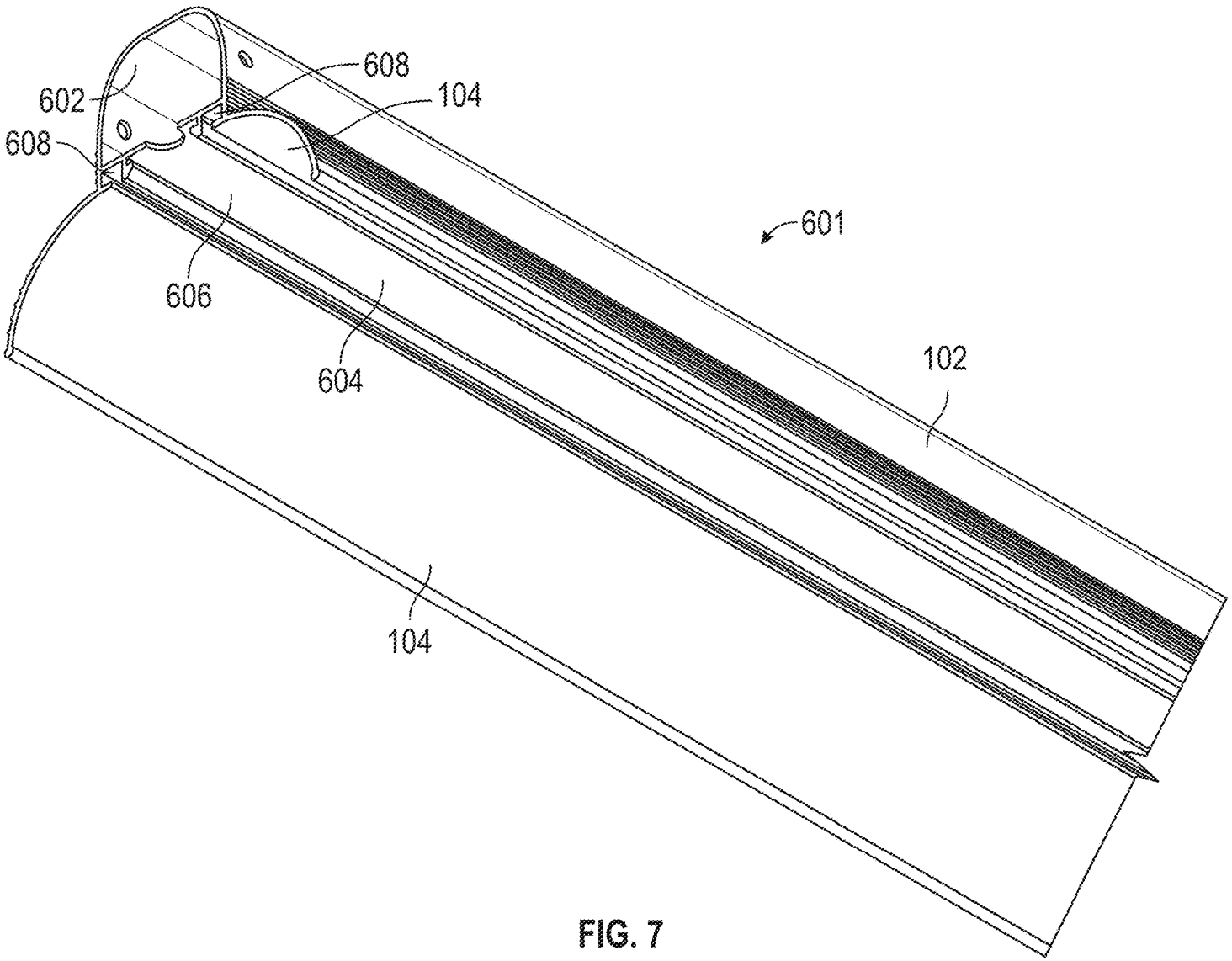
FIG. 7 is a bottom perspective view of a portion of the light fixture of FIG. 6 with an end cap of the light fixture removed.
Figure 8:
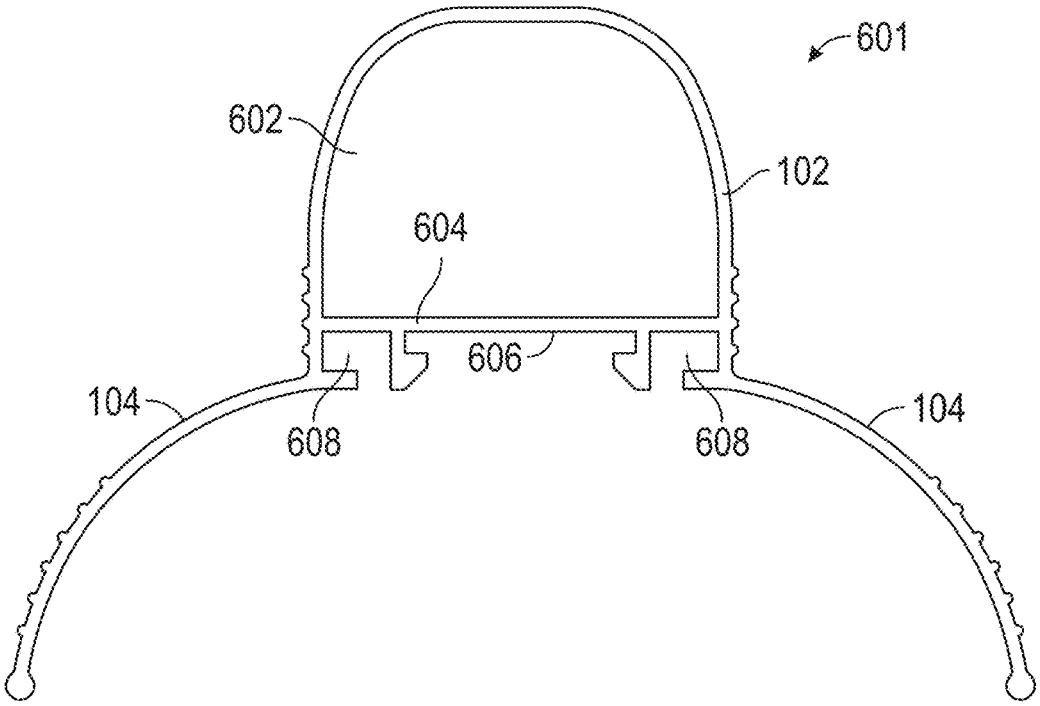
FIG. 8 is an end view of the light fixture of FIG. 6 with end caps of the light fixture removed.

As illustrated in FIGS. 6-8, the housing 102 defines a cavity 602 that is configured to accommodate the electrical components of the light fixture 600. In some examples, the housing 102 includes a mounting plate 604, and the electrical components of the light fixture 600 are optionally supported on the mounting plate 604 within the cavity 602. In various examples, the housing 102 optionally defines one or more light source mounting slot(s) 606 and/or an optic mounting slot(s) 608 for retaining of the light source and optic, respectively, on the fixture 600. In the example illustrated in FIGS. 7 and 8, the light source mounting slot 606 is configured to slidably receive a PCB 1206 with LEDs 1204 (see FIG. 14) such that the LEDs 1204 emit light directly downwardly from the fixture 600. The optic mounting slots 608 are configured to receive mounting arms 610 of the optic 106 such that the optic 106 is slidably mounted on the housing 102.

Figure 9:
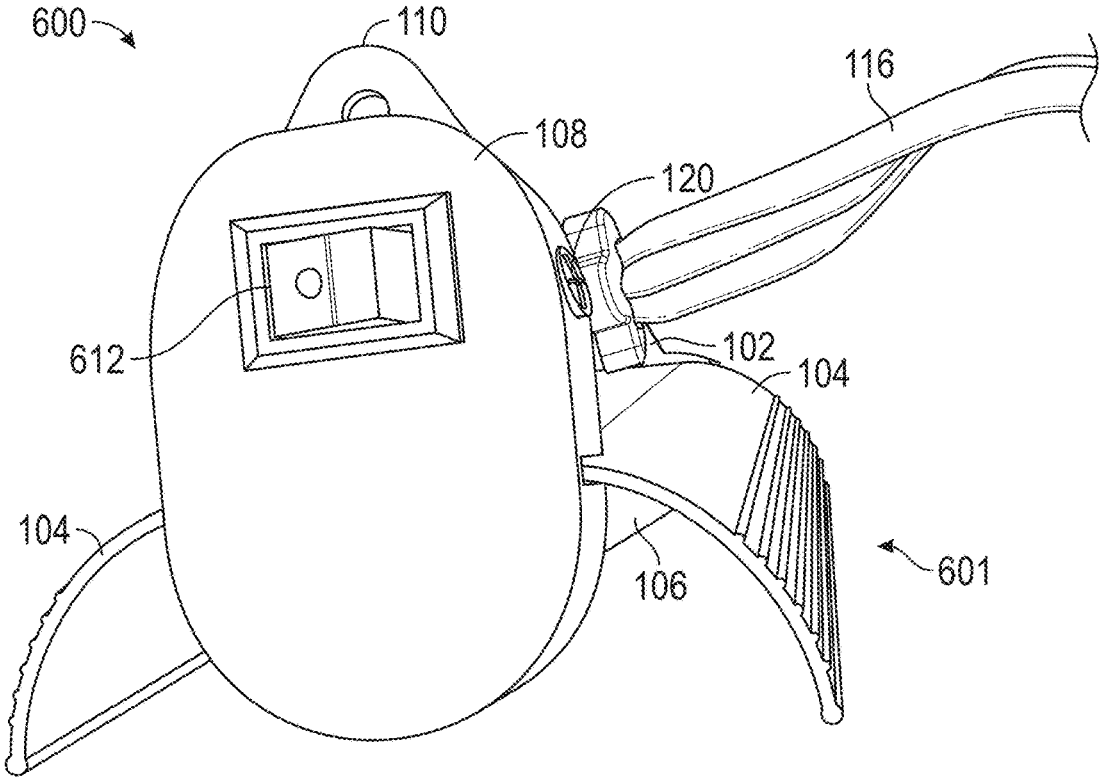
FIG. 9 is an end view of the light fixture of FIG. 6.
Figure 10:
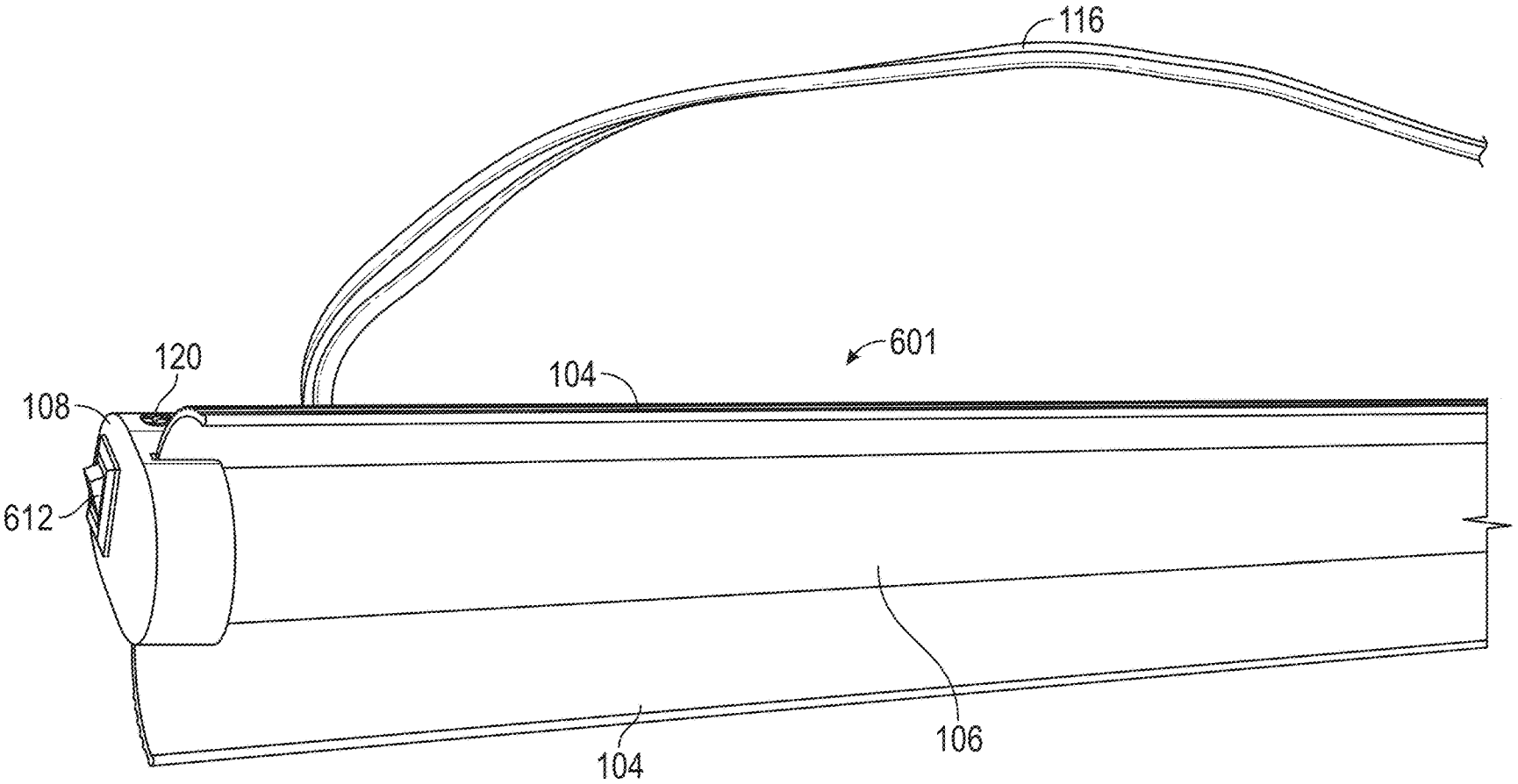
FIG. 10 is a bottom perspective view of a portion of the light fixture of FIG. 6.
Figure 11:
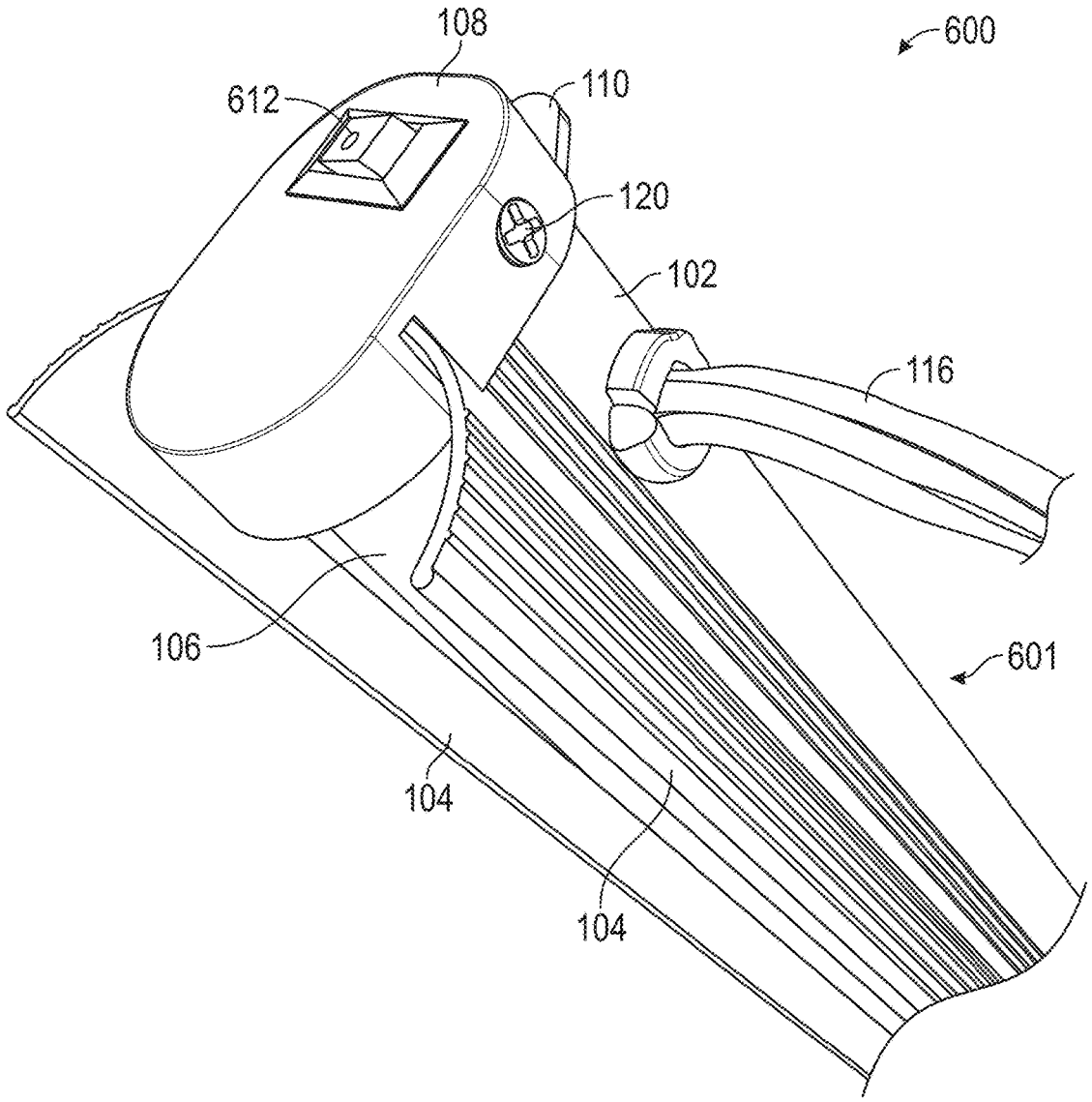
FIG. 11 is another perspective view of a portion of the light fixture of FIG. 6.
Figure 12:
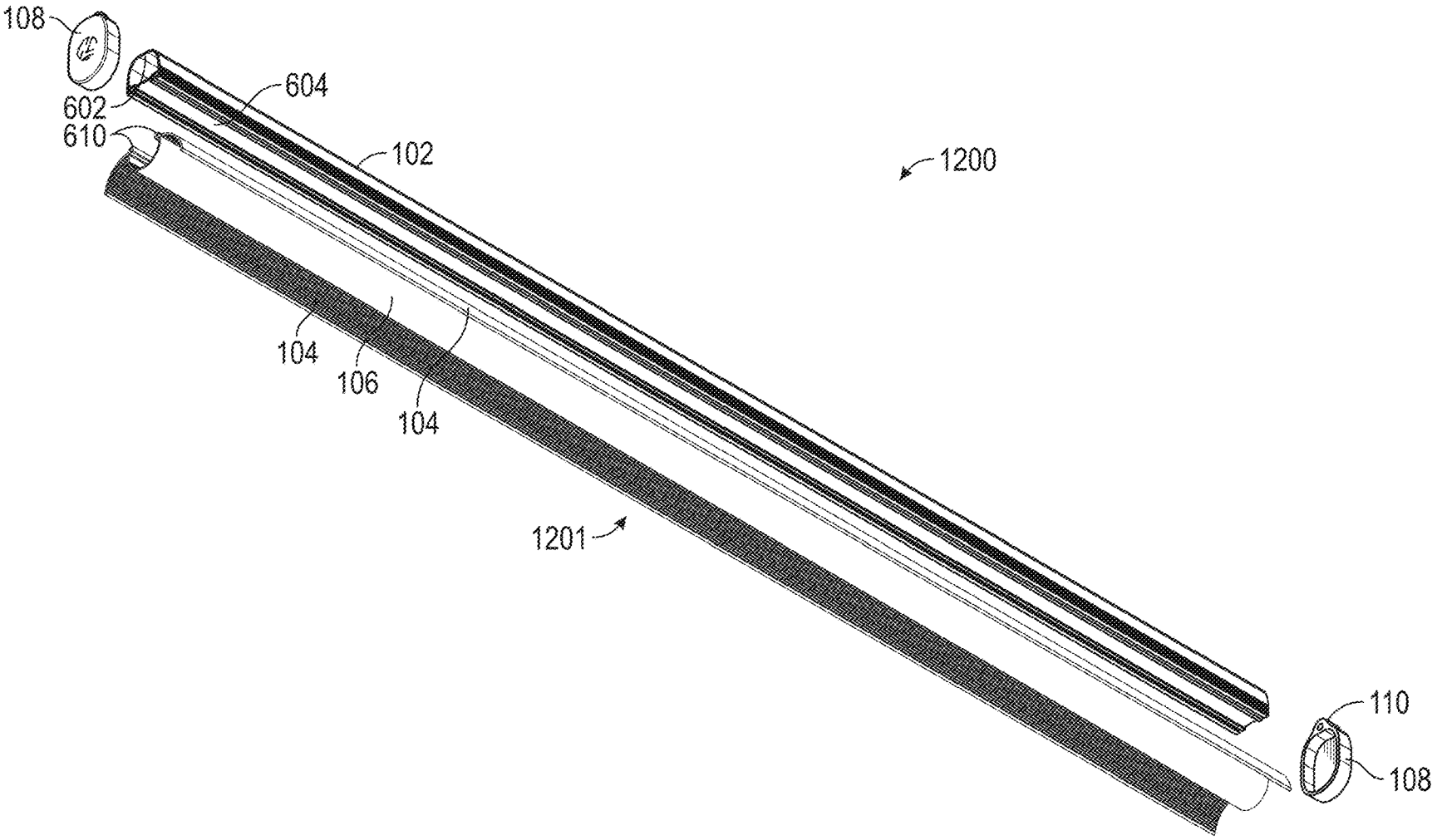
FIG. 12 is an exploded assembly view of an example of a light fixture according to embodiments of the present disclosure.
Figure 13:
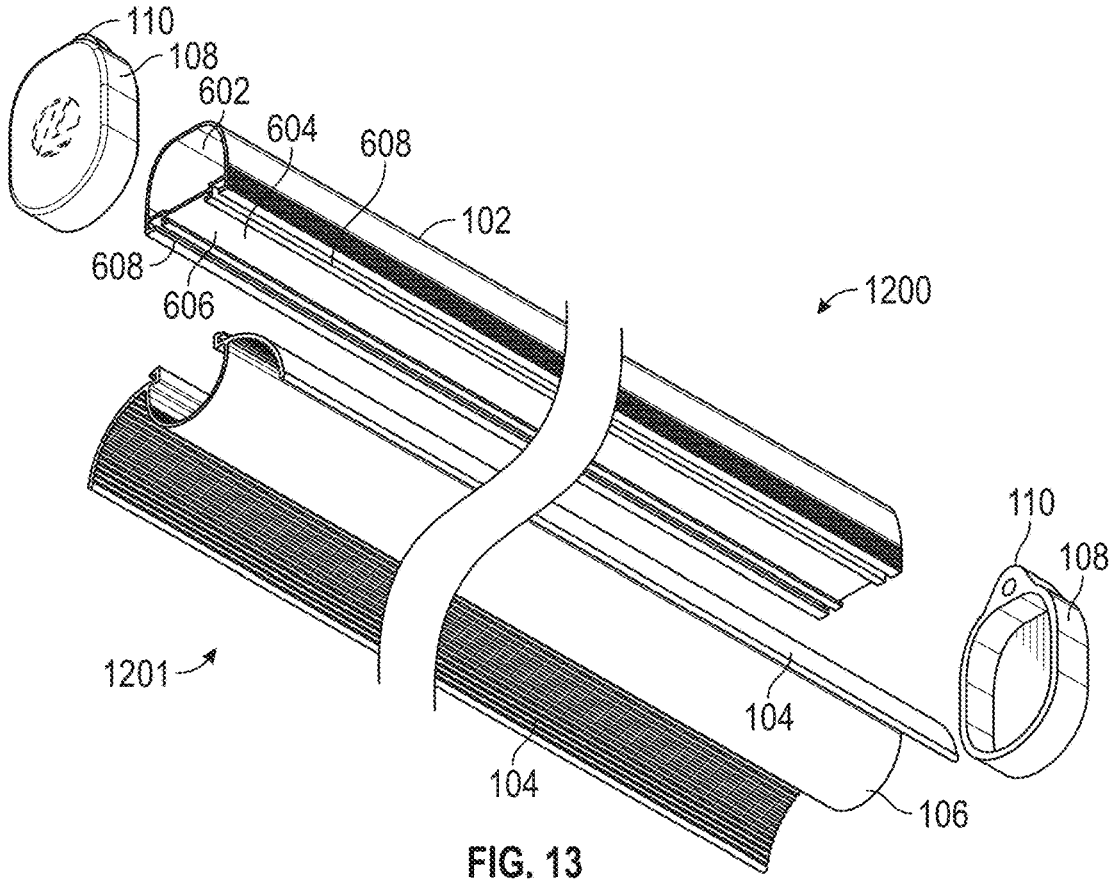
FIG. 13 is an exploded assembly view of a portion of the light fixture of FIG. 12.

Compared to the light fixture 100, in the light fixture 600, the lower surfaces of the wings 104 are optionally smooth and the upper surfaces of the wings 104 are optionally textured, although they need not be. As illustrated in FIGS. 9-11, a switch 612 for selectively turning the light fixture 600 "on" and "off" is provided on one of the end caps 108.

FIGS. 12-15 illustrate another embodiment of a light fixture 1200. The light fixture 1200 is substantially similar to the light fixtures 100, 600 except that the optic 106 and wings 104 are monolithically formed as a single, integral unit 1201, and the unit 1201 is removable from the housing 102. In some non-limiting examples, the optic 106 and wings 104 both include a translucent material such as translucent plastic.

Figure 14:
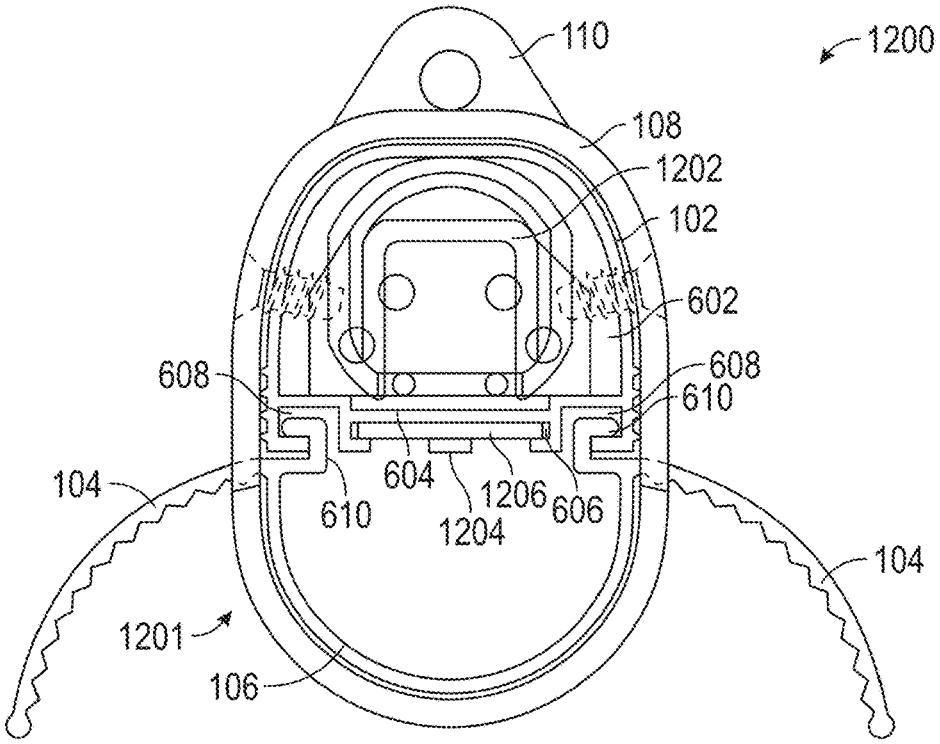
FIG. 14 is an end view of the light fixture of FIG. 12 with an end cap of the light fixture removed.
Figure 15:
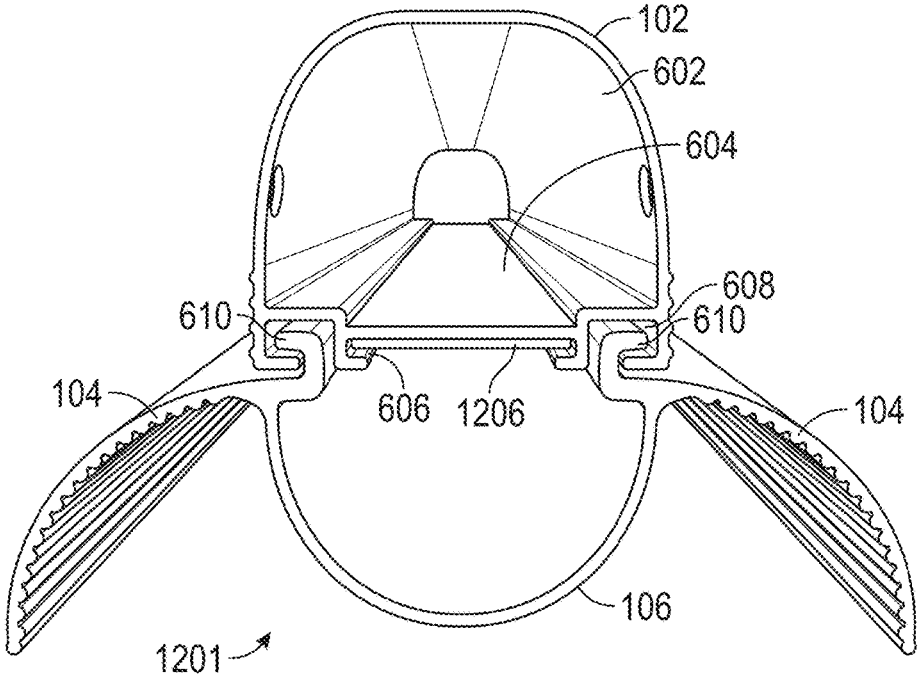
FIG. 15 is a perspective view of an optic and housing of the light fixture of FIG. 12.
Figure 16:
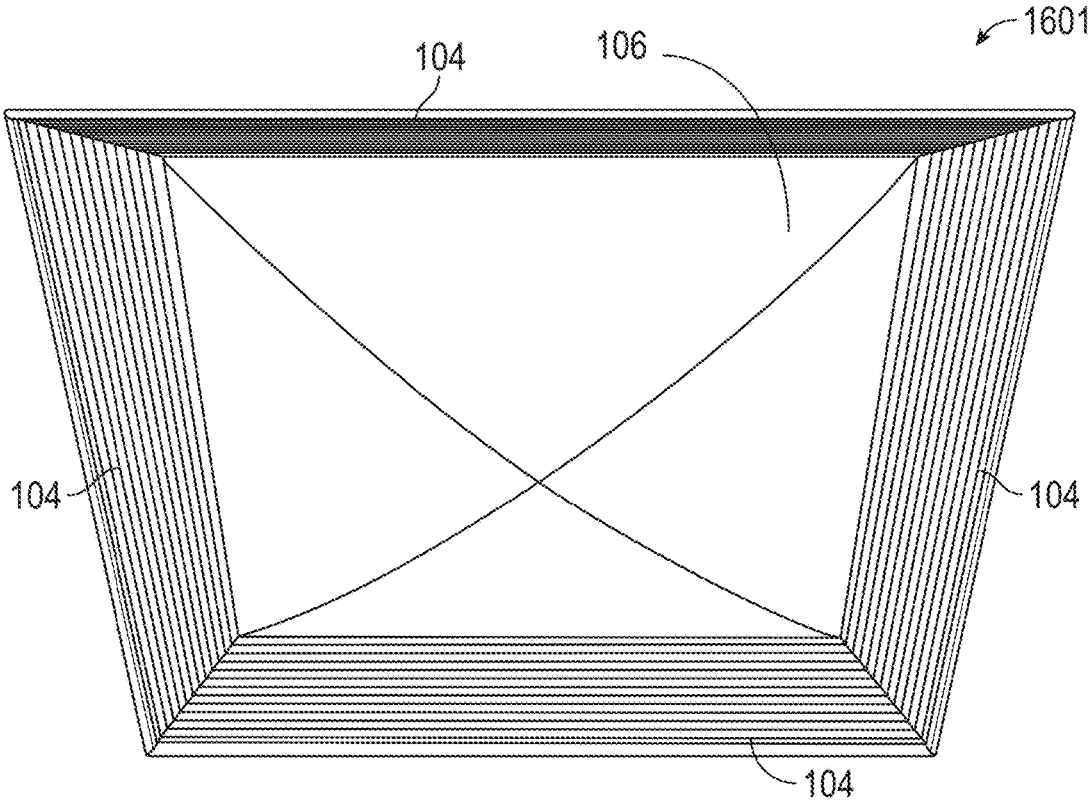
FIG. 16 is a bottom perspective view of a light fixture according to embodiments of the present disclosure.
Figure 17:
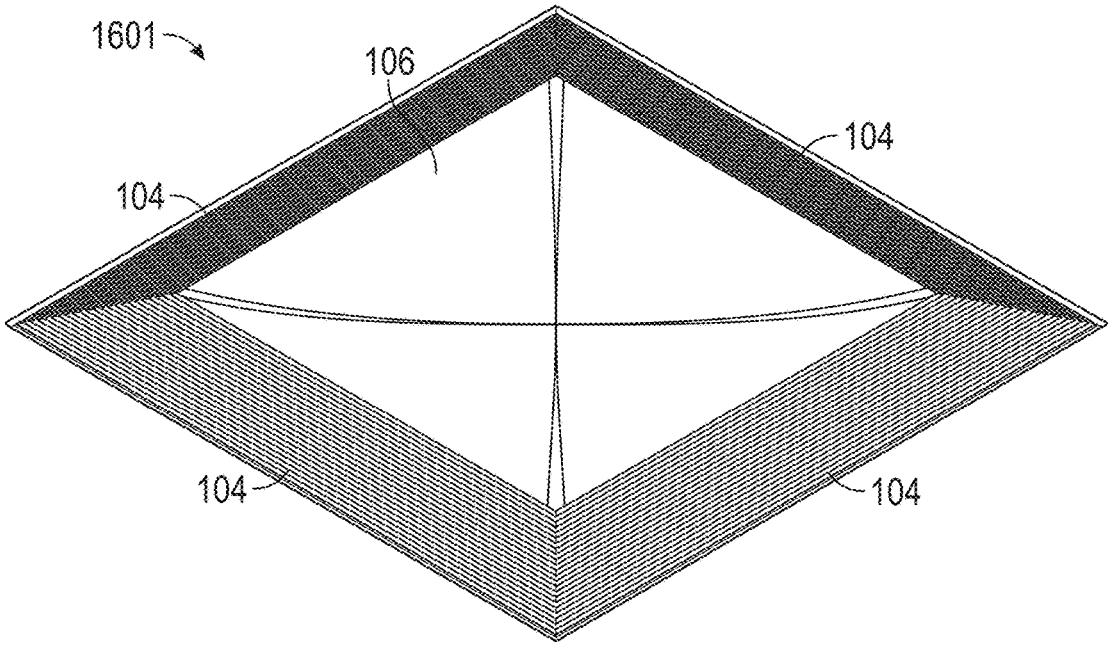
FIG. 17 is a top perspective view of the light fixture of FIG. 16.
Figure 18:
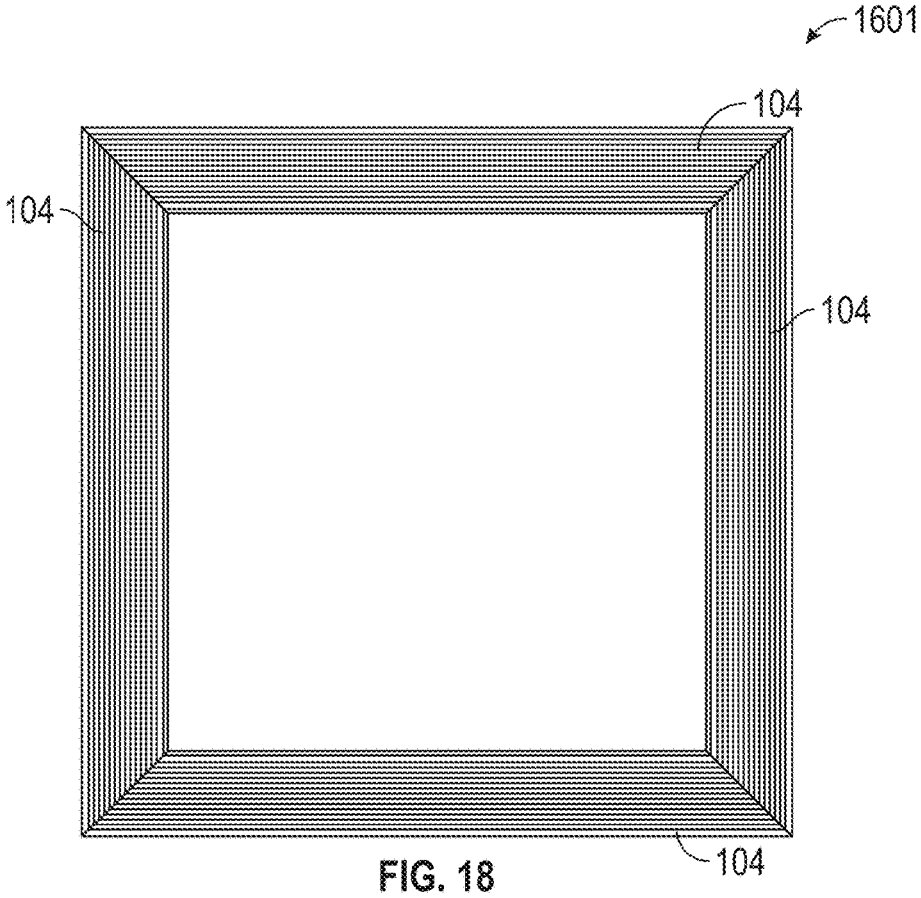
FIG. 18 is a bottom view of the light fixture of FIG. 16.
Figure 19:
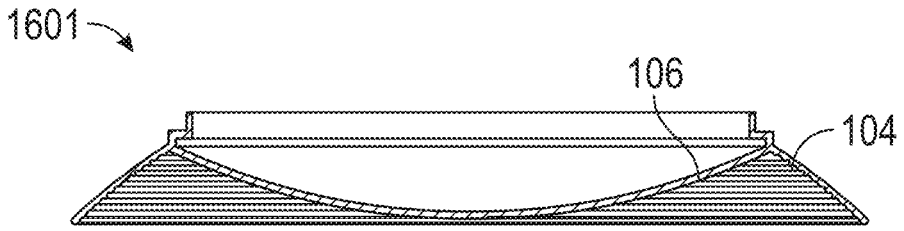
FIG. 19 is a side view of the light fixture of FIG. 16.
Figure 20:
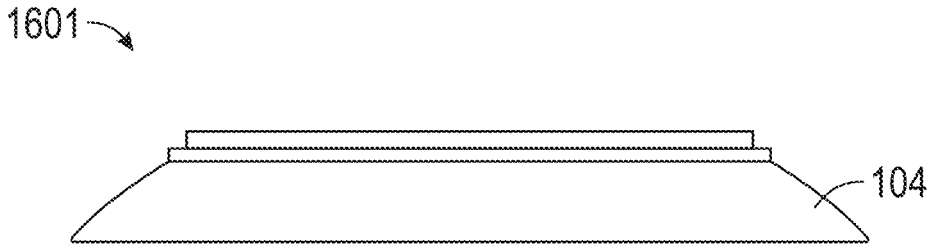
FIG. 20 is a sectional view of the light fixture of FIG. 16.
Figure 21:
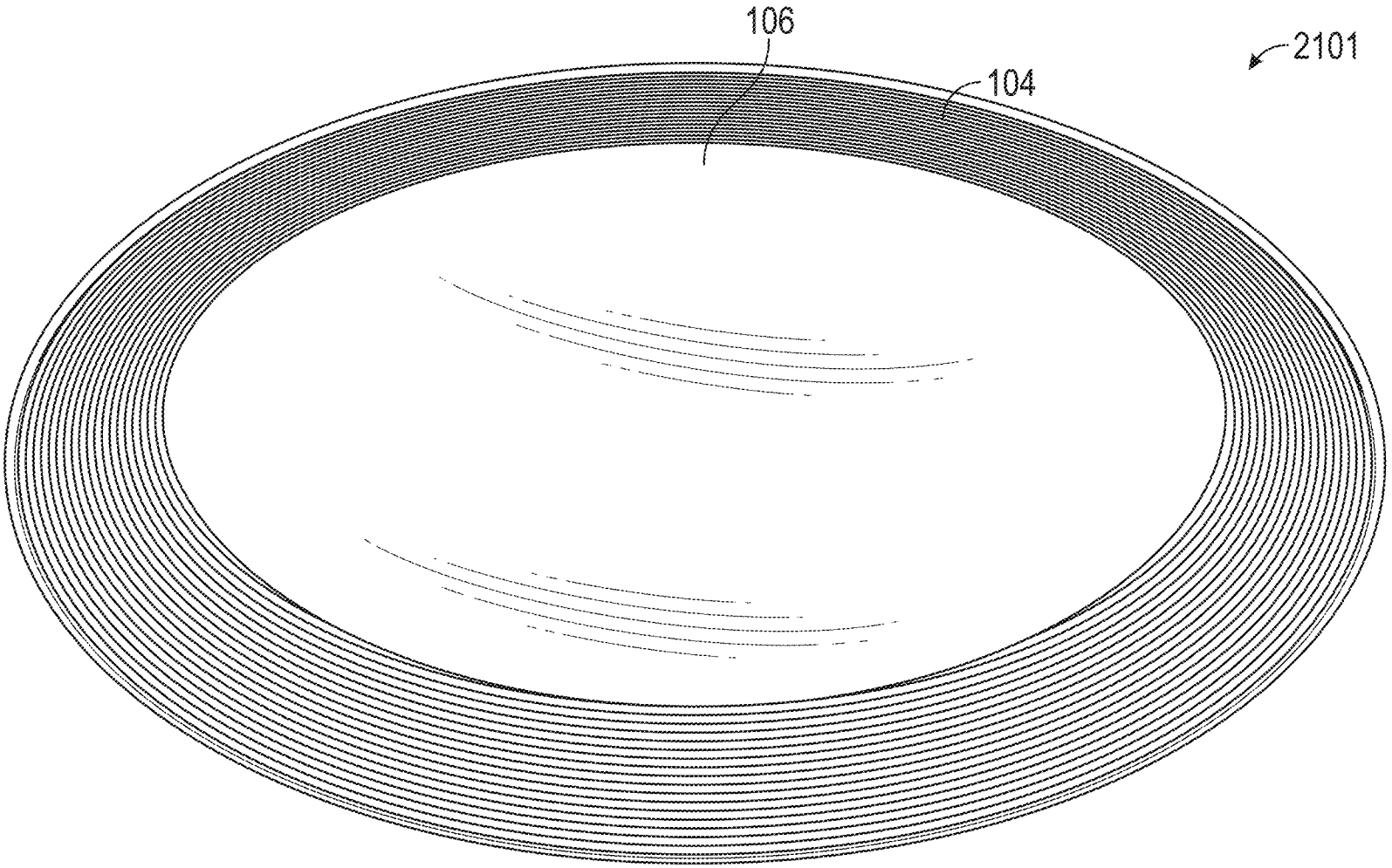
FIG. 21 is a bottom perspective view of a light fixture according to embodiments of the present disclosure.
Figure 22:
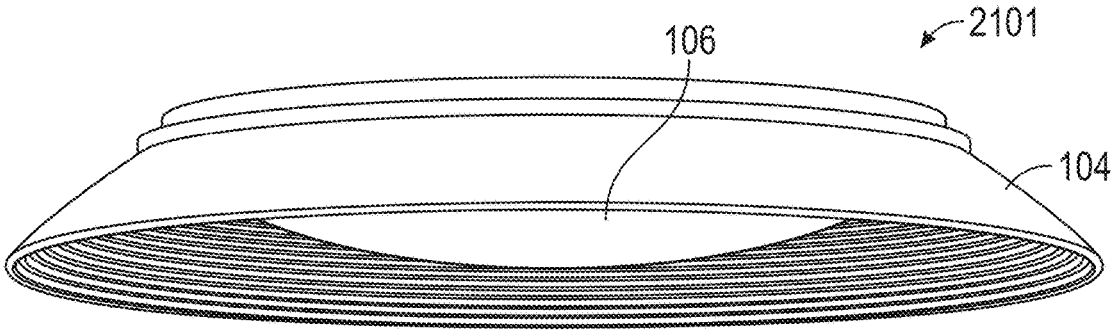
FIG. 22 is another bottom perspective view of the light fixture of FIG. 21.
Figure 23:
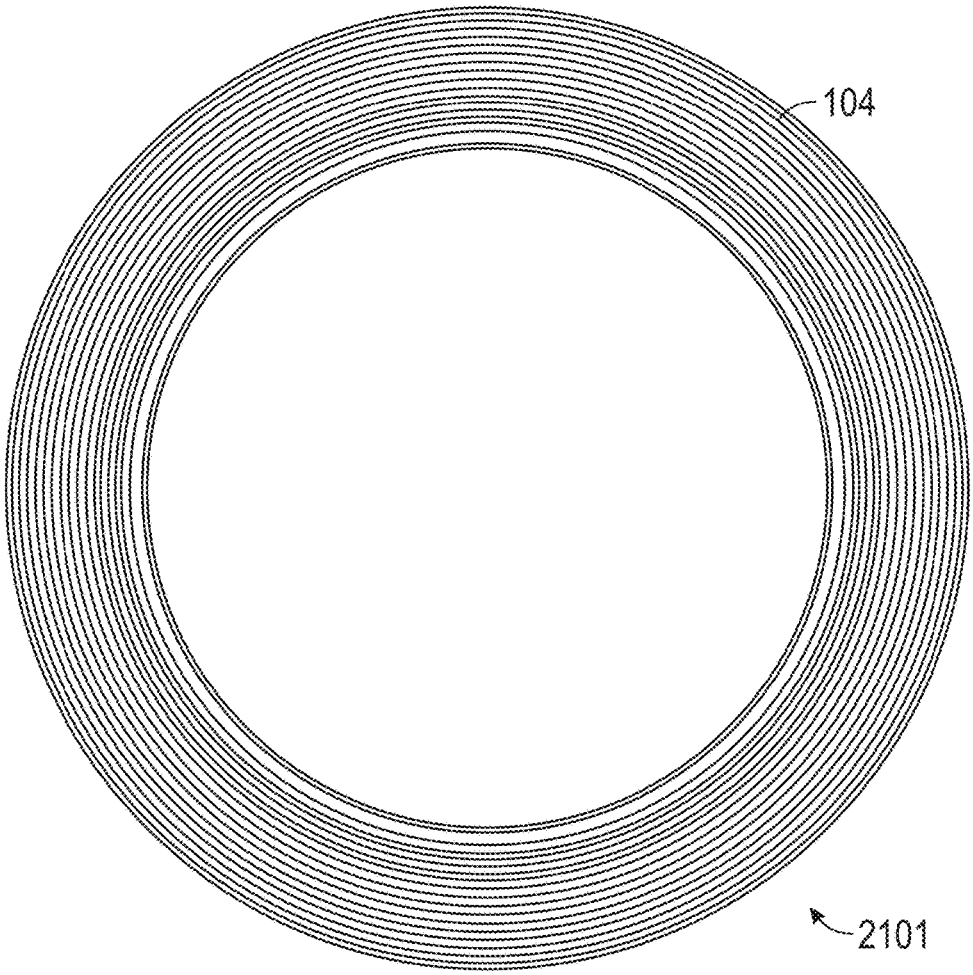
FIG. 23 is a bottom view of the light fixture of FIG. 21.
Figure 24:
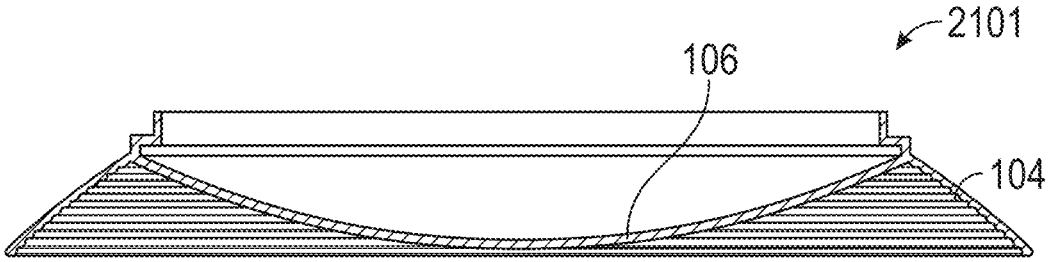
FIG. 24 is a side view of the light fixture of FIG. 21.
Figure 25:
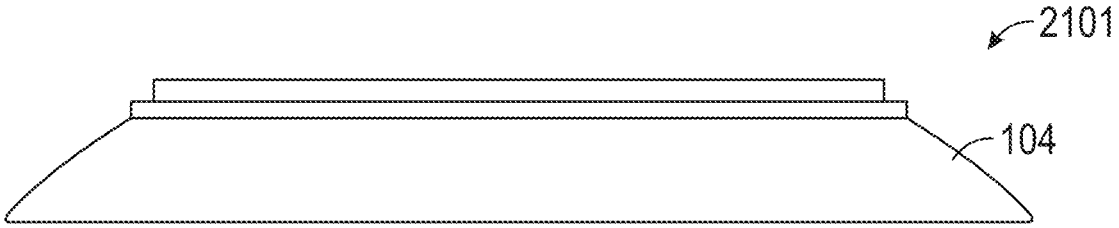
FIG. 25 is a sectional view of the light fixture of FIG. 21.

Similar to the wings 104 of the light fixture 100, the lower surfaces of the wings 104 of the light fixture 1200 are optionally textured and the upper surfaces of the wings 104 are optionally smooth, although they need not be. As illustrated in FIG. 14, in various aspects, electronic components of the light fixture 1200, such as a driver 1202, are provided in the cavity 602 of the housing 102 and optionally on the mounting plate 604.

Referring to FIG. 14, optionally a light source includes at least one LED 1204 optionally mounted on a PCB 1206. In this example, the PCB 1206 is slidably mounted in the light source mounting slot 606 such that the LED 1204 emits light directly downwardly from the light fixture 1200. As previously described, in other embodiments, the light source mounting slot 606 may be angled such that the LED 1204 (or other light source) emits light at an angle to nadir.

FIGS. 16-20 illustrate another embodiment of the optic 106 and wings 104 monolithically formed as a single, integral unit 1601. Compared to the linear light fixtures 100, 600, and 1200, the optic 106 and wings 104 of FIGS. 16-20 are squared. In addition, the unit 1601 includes four wings 104 compared to the light fixtures 100, 600, and 1200.

FIGS. 21-25 illustrate another embodiment of the optic 106 and wings 104 monolithically formed as a single, integral unit 2101. Compared to the linear light fixtures 100, 600, and 1200, the optic 106 and wings 104 of FIGS. 21-25 are round.

Figure 26:
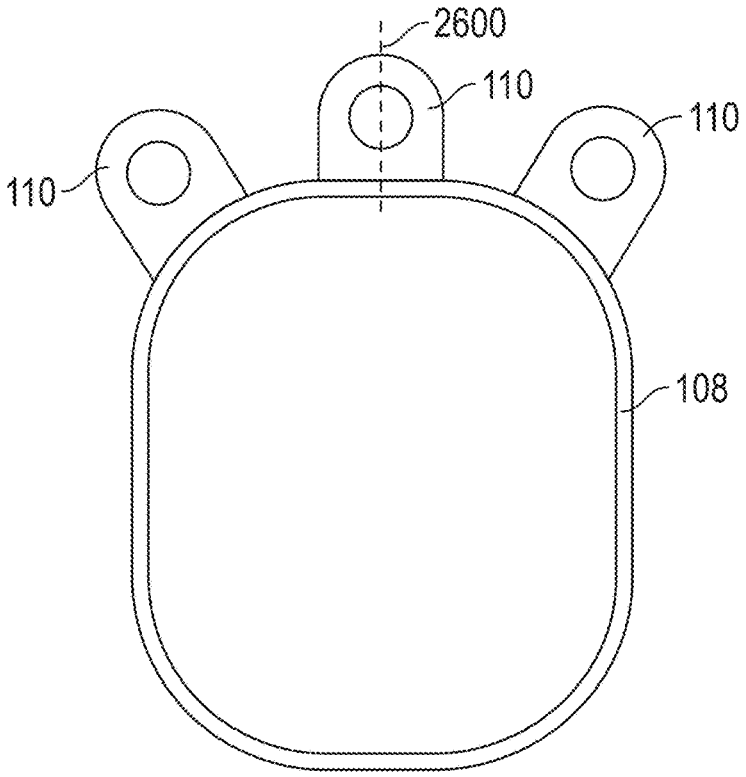
FIG. 26 is a side view of an example of an end cap for a light fixture according to embodiments of the present disclosure.

FIG. 26 illustrates an example of an end cap 108 having a plurality of eyelets 110 arranged in a configuration relative to a centerline 2600 of the end cap 108. During installation, chains or other mounting features can engage the eyelets 110 to suspend fixture. Multiple eyelets may be positioned on each end cap to permit mounting of the fixture in different angular orientations such that the tilt of the fixture (and thus the directionality of emitted light from the fixture) can be controlled and adjusted.

Figure 27:
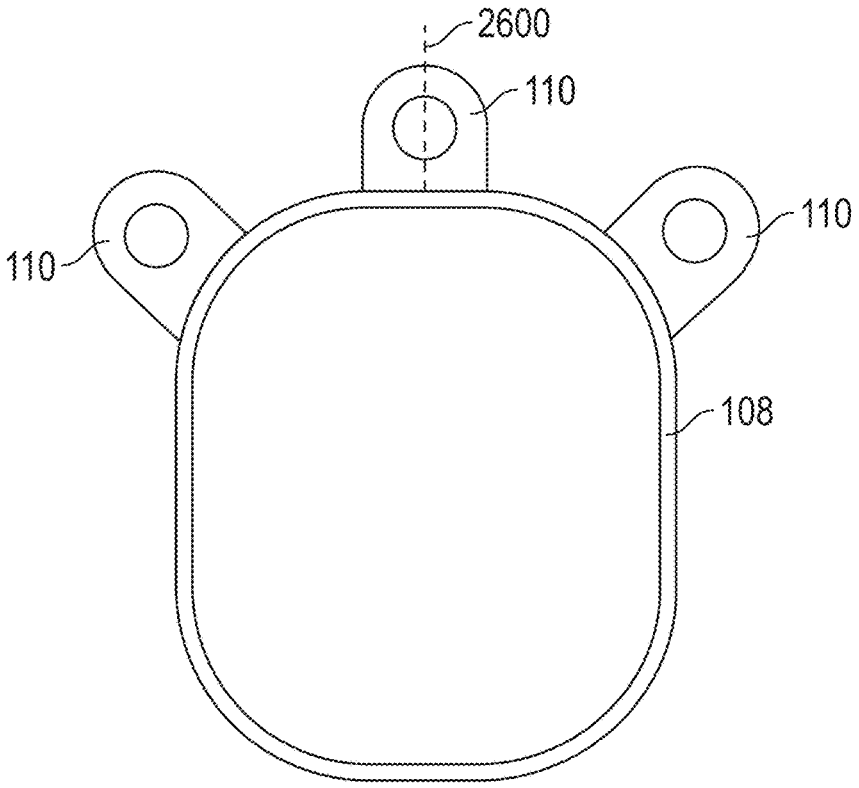
FIG. 27 is a side view of an example of an end cap for a light fixture according to embodiments of the present disclosure.
Figure 28:
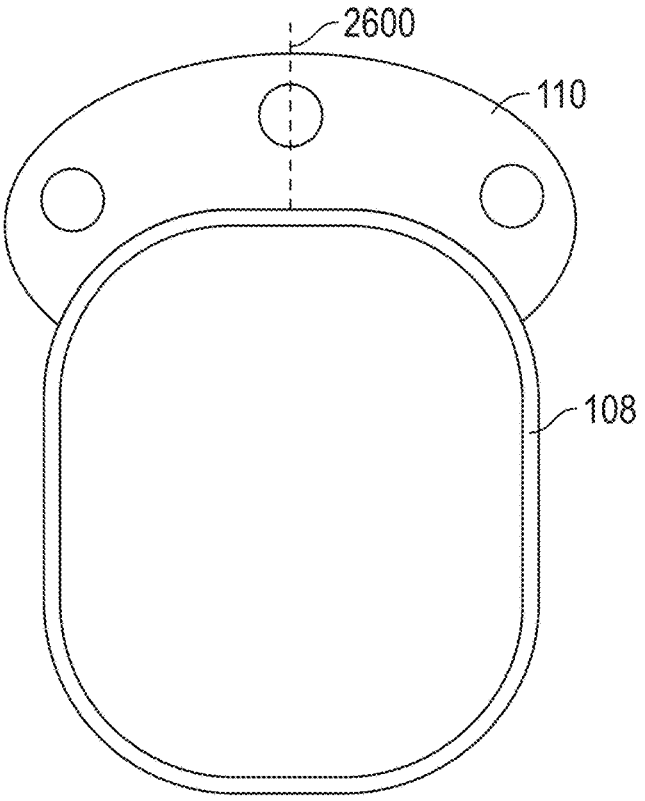
FIG. 28 is a side view of an example of an end cap for a light fixture according to embodiments of the present disclosure.
Figure 29:
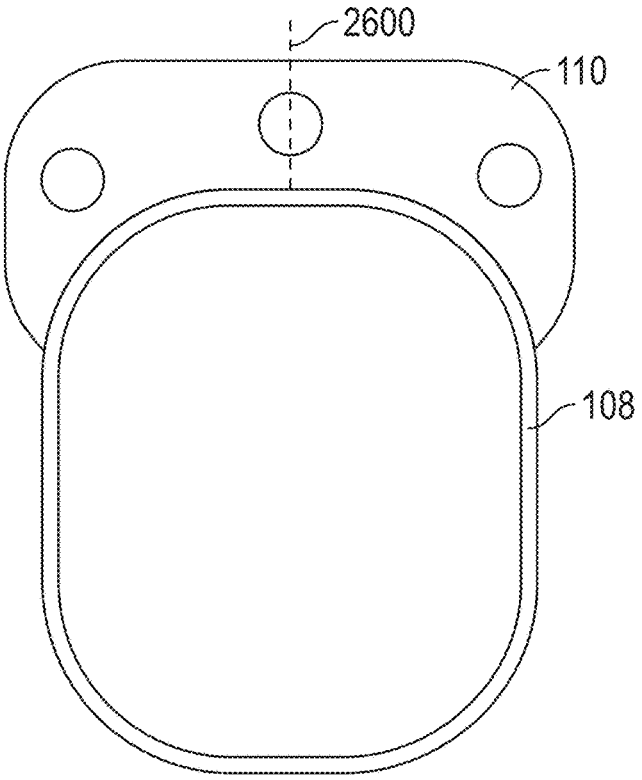
FIG. 29 is a side view of an example of an end cap for a light fixture according to embodiments of the present disclosure.
Figure 30:
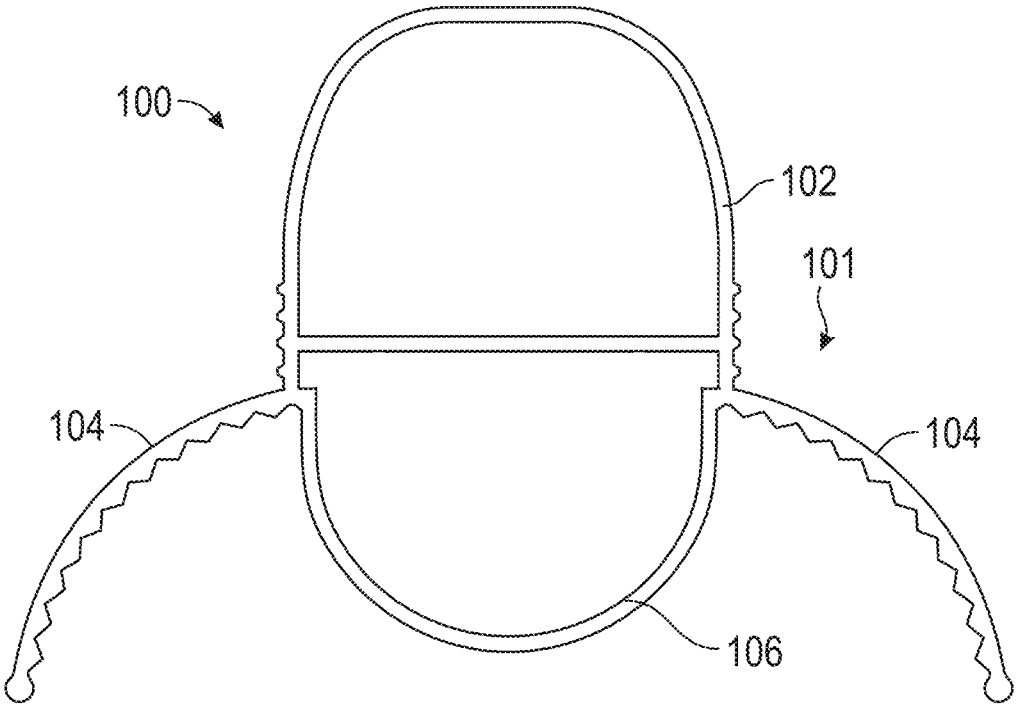
FIG. 30 is an end view of the light fixture of FIG. 1 with end caps of the light fixture removed.

FIG. 27 illustrates another example of an end cap 108 having a plurality of eyelets 110 arranged in another configuration relative to the centerline 2600. Compared to the end cap of FIG. 26, the outer eyelets 110 of the end cap of FIG. 27 are at a greater angle relative to the centerline 2600. FIG. 28 illustrates another example of an end cap 108 with a plurality of eyelets 110. FIG. 29 illustrates another example of an end cap 108 with a plurality of eyelets 110.

The foregoing is provided for purposes of illustrating, explaining, and describing embodiments of the present invention. Further modifications and adaptations to these embodiments will be apparent to those skilled in the art and may be made without departing from the scope or spirit of the invention. Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the invention.

That which is claimed:

1. A light fixture comprising:

a housing configured to house at least one light source of the light fixture;

an optic; and a wing extending from a side of the housing, wherein the housing, optic, and wing are monolithically formed as an integral unit.

2. The light fixture of claim 1, wherein the housing comprises a thermally conductive plastic and wherein the optic comprises a translucent plastic.

3. The light fixture of claim 2, wherein the wing is constructed from the thermally conductive plastic or the translucent plastic.

4. The light fixture of claim 1, wherein the wing is a first wing, and wherein the light fixture further comprises a second wing extending from a side of the housing opposite from the first wing.

5. The light fixture of claim 1, further comprising end caps positioned on opposing ends of the light fixture.

6. The light fixture of claim 1, further comprising the at least one light source, wherein the at least one light source comprises a plurality of light emitting diodes (LEDs).

7. The light fixture of claim 6, wherein the optic extends below the plurality of LEDs.

8. A light fixture comprising:

a housing configured to house at least one light source of the light fixture;

an optic; and a wing extending from a side of the housing, wherein the housing and wing are monolithically formed as an integral unit, and wherein the wing is configured to at least partially direct light emitted through the optic from the at least one light source of the light fixture.

9. The light fixture of claim 8, wherein the housing and wing comprise a metal or a thermally conductive plastic.

10. The light fixture of claim 8, wherein the wing is a first wing, and wherein the light fixture further comprises a second wing extending from a side of the housing opposite from the first wing.

11. The light fixture of claim 8, wherein the housing comprises optic mounting slots extending along a length of the housing, and wherein the optic comprises mounting arms configured to engage the optic mounting slots such that the optic is slidably mounted on the housing.

12. The light fixture of claim 8, further comprising end caps positioned on opposing ends of the light fixture.

13. The light fixture of claim 8, further comprising the at least one light source, wherein the at least one light source comprises a plurality of light emitting diodes.

14. A light fixture comprising:

a housing configured to house at least one light source of the light fixture;

an optic; and a wing extending from a side of the housing, wherein the optic and wing are monolithically formed as an integral unit.

15. The light fixture of claim 14, wherein the optic and wing comprise a translucent plastic.

16. The light fixture of claim 14, wherein the housing comprises optic mounting slots extending along a length of the housing, and wherein the optic comprises mounting arms configured to engage the optic mounting slots such that the optic and wing are slidably mounted on the housing.

17. The light fixture of claim 14, wherein the wing is a first wing, and wherein the light fixture further comprises a second wing extending from a side of the housing opposite from the first wing.

18. The light fixture of claim 14, wherein a cross-sectional geometry of the wing is arcuate shaped.

19. The light fixture of claim 14, further comprising end caps positioned on opposing ends of the light fixture.

20. The light fixture of claim 14, further comprising the at least one light source, wherein the at least one light source comprises a plurality of light emitting diodes.

* * * * *